US010829950B1

(12) United States Patent
Fried

(10) Patent No.: US 10,829,950 B1
(45) Date of Patent: Nov. 10, 2020

(54) SYSTEM AND METHOD FOR DYNAMICALLY BRACING A BUCKLING MASONRY WALL

(71) Applicant: Craft Pro Masonry Restorations, Inc., Hulmeville, PA (US)

(72) Inventor: Michael Fried, Hulmeville, PA (US)

(73) Assignee: Craft Pro Masonry Restorations, Inc., Hulmeville, PA (US)

( * ) Notice: Subject to any disclaimer, the term of this patent is extended or adjusted under 35 U.S.C. 154(b) by 0 days.

(21) Appl. No.: 16/532,418

(22) Filed: Aug. 5, 2019

(51) Int. Cl.
*E04G 23/04* (2006.01)
*E04G 21/24* (2006.01)
*E04G 21/12* (2006.01)

(52) U.S. Cl.
CPC ..... *E04G 23/04* (2013.01); *E04G 21/126* (2013.01); *E04G 21/24* (2013.01)

(58) Field of Classification Search
CPC ..... E04G 21/24; E04G 21/26; E04G 23/0229; E04G 23/04
USPC ..... 52/741.3
See application file for complete search history.

(56) References Cited

U.S. PATENT DOCUMENTS 2,945,662 A * 7/1960 Jennings ..... E04G 17/14 254/100
3,817,006 A * 6/1974 Williams ..... E04G 21/26 52/127.2
3,874,625 A * 4/1975 Hansen ..... E04G 21/26 248/354.5
4,068,427 A * 1/1978 Camardo ..... E04G 21/26 52/127.2
4,070,833 A * 1/1978 Hancock ..... E04G 21/26 52/148
5,481,836 A * 1/1996 Miller ..... E04G 21/26 52/127.2
5,956,906 A 9/1999 Berich et al.
6,357,190 B1 * 3/2002 Florentine ..... E02D 37/00 248/351
6,539,677 B1 * 4/2003 Lanka ..... E04G 17/002 248/354.3
6,752,570 B2 * 6/2004 Lanka ..... E04G 21/26 405/272
7,380,372 B2 6/2008 Resch et al.
8,028,476 B1 * 10/2011 Alford ..... E04H 4/0043 52/126.4
10,450,764 B2 * 10/2019 Woodford ..... E04G 23/04
2003/0147706 A1 * 8/2003 Kennedy ..... E21F 1/10 405/288
2003/0190196 A1 * 10/2003 Lanka ..... E04G 21/26 405/272

(Continued)

*Primary Examiner* — Paola Agudelo
(74) *Attorney, Agent, or Firm* — LaMorte & Associates P.C

(57) ABSTRACT

A system and method for supporting a buckled wall. The system positions a support structure adjacent the buckling wall in order to stop or diminish additional buckling. The support structure consists of a base beam that runs along the ground parallel to the wall. At least one lateral leg extends from the base beam to make a stable base. A vertical beam extends upwardly from the base. One or more jacks are used to tilt the base and the vertical beam toward the buckling wall. Contact braces are supported by the vertical beam. Each of the contact braces has a faceplate that can be individually adjusted into contact with the buckling wall. The faceplates can articulate and match the angle of the wall where contacted.

19 Claims, 6 Drawing Sheets

(56) References Cited

U.S. PATENT DOCUMENTS

| | | | | |
|---|---|---|---|---|
| 2005/0072059 | A1* | 4/2005 | Hodsdon | E04G 21/26 52/64 |
| 2006/0080926 | A1* | 4/2006 | Resch | E04G 23/0218 52/474 |
| 2007/0175174 | A1* | 8/2007 | Bruno | E04G 17/14 52/745.12 |
| 2009/0057518 | A1* | 3/2009 | Russell | E04G 21/26 248/354.1 |
| 2010/0037538 | A1* | 2/2010 | Sorich | E04G 21/26 52/127.2 |
| 2011/0079698 | A1* | 4/2011 | Pezzimenti | E04G 21/26 248/354.5 |
| 2018/0245360 | A1* | 8/2018 | Woodford | E04G 23/0229 |

* cited by examiner

SYSTEM AND METHOD FOR DYNAMICALLY BRACING A BUCKLING MASONRY WALL

BACKGROUND OF THE INVENTION

1. Field of the Invention

In general, the present invention relates to bracing systems that are used to support a wall that may be leaning or buckling. More particularly, the present invention relates to external bracing systems that can be erected next to a wall for the purpose of bracing the wall.

2. Prior Art Description

In the construction industry, bricks are often used to create both load bearing walls and façade walls. Load bearing walls have multiple wythes wherein header bricks are typically used to interconnect the wythes. Various brick laying patterns, such a stretcher bond pattern, an English bond pattern, a Flemish bond pattern and/or the like can be used in the construction of the wall. Brick walls with multiple interlocked wythes are robust and typically only buckle if the wall foundation fails or if the wall is subjected to stresses sufficient to break the header bricks that extend between the wythes.

Single wythe brick walls are also commonly used in construction. These walls are often used as facades or are part of cavity walls. Cavity walls are a construct where two parallel brick walls are constructed with a gap space between the walls. In façade walls and cavity walls, the single outer wythe of bricks is affixed to metal anchors that join the outer wythe to an inner wall or an inner wythe. Such single wythe walls are typically made with intermittent weep holes that enable any moisture behind the outer wythe to escape.

Over time, weep holes in masonry walls tend to become clogged. Furthermore, they are often plugged and painted by building owners who are unaware of the importance of such features. Once weep holes are plugged. Moisture can accumulate behind the outer wythe. This can cause wall anchors and metal support surfaces to rust and/or fail. As metal support surfaces in a masonry wall rust, those support surfaces expand. The force of the expansion is enough to lift sections of the wall and to cause bricks to crack. Furthermore, as anchors rust and fail, the supporting interconnection between the bricks in the outer wythe and the inner wall are lost. The result is that the outer wythe loses support integrity. The weight of the wall and/or any loads on the wall can then cause the wall to begin to buckle.

Once a wall begins to buckle, the process is progressive. Over time, the buckle will slowly increase. As the wall buckles, more water is able to flow behind the wall, therein further compromising the wall. This effect exponentially increases until the wall falls. Once wall buckles only a few degrees, it typically cannot be fixed in an economical fashion. Rather, it is best practice to tear the wall down and build a new wall. This is a labor intensive and time-consuming process.

It may take time for a building owner to prepare finances and logistics needed to rebuild a wall of a building. In order to obtain this time, the buckling wall of the building must be braced or otherwise prevented from further buckling and collapsing. Typically, a wall is braced using framing lumber. However, this approach requires a high degree of carpentry skill as well as sufficient room to build a wooden bracing structure. Many buildings have buckling walls that face alleyways, streets, property lines or the like. As such, there is often not enough room to build an adequate bracing support out of lumber.

In the prior art, prefabricated bracing systems have been made to support buckling walls. Such bracing systems are exemplified by U.S. Pat. No. 5,956,906 to Berich. The problem with such prior art bracing systems is that they assume that the wall being supported is flat. By definition, a buckling wall is not flat. Rather, there is a section of the wall that is buckled and is protruding from the primary plane of the wall. As a consequence, when a prior art support brace is applied to a buckling wall, it must be positioned under the buckle, where the wall is flat. Otherwise, the support brace must be applied across the buckle, where it makes limited contact with the wall and therefore provides limited support.

A need therefore exists for an improved support system that is capable of bracing a wall by contacting the wall at multiple non-planar positions. In this manner, the support system can support a wall above, below, and across a section that is buckling. This need is met by the present invention as described and claimed below.

SUMMARY OF THE INVENTION

The present invention is a system and method for supporting a buckled wall. The system positions a support structure adjacent the buckling wall in order to stop or diminish additional buckling over time. The support structure consists of a portable base that can be positioned adjacent the buckling wall. The portable base has a base beam that runs along the ground parallel to the wall. At least one lateral leg extends from the base beam to make the portable base stable and enable the base to support a vertical beam.

The vertical beam extends upwardly from the portable base and adjacent the buckling wall. One or more jacks are used to tilt the portable base and the vertical beam toward the buckling wall.

A plurality of contact braces are supported by the vertical beam. Each of the contact braces has a separate faceplate that can be individually adjusted into contact with the buckling wall. The faceplates can articulate and match the angle of the wall where contacted. By advancing the contact braces and by tilting the vertical beam toward the buckling wall, support forces can be applied to the buckling wall at multiple points along the buckling wall. The support forces stabilize the wall and provide time for the wall to be demolished and rebuilt or otherwise corrected.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention bracing support system can be embodied in many ways, only a few exemplary embodiments are illustrated. The exemplary embodiments are being shown for the purposes of explanation and description. The exemplary embodiments are selected in order to set forth some of the best modes contemplated for the invention. The illustrated embodiments, however, are merely exemplary and should not be considered limitations when interpreting the scope of the appended claims.

Figure 1:
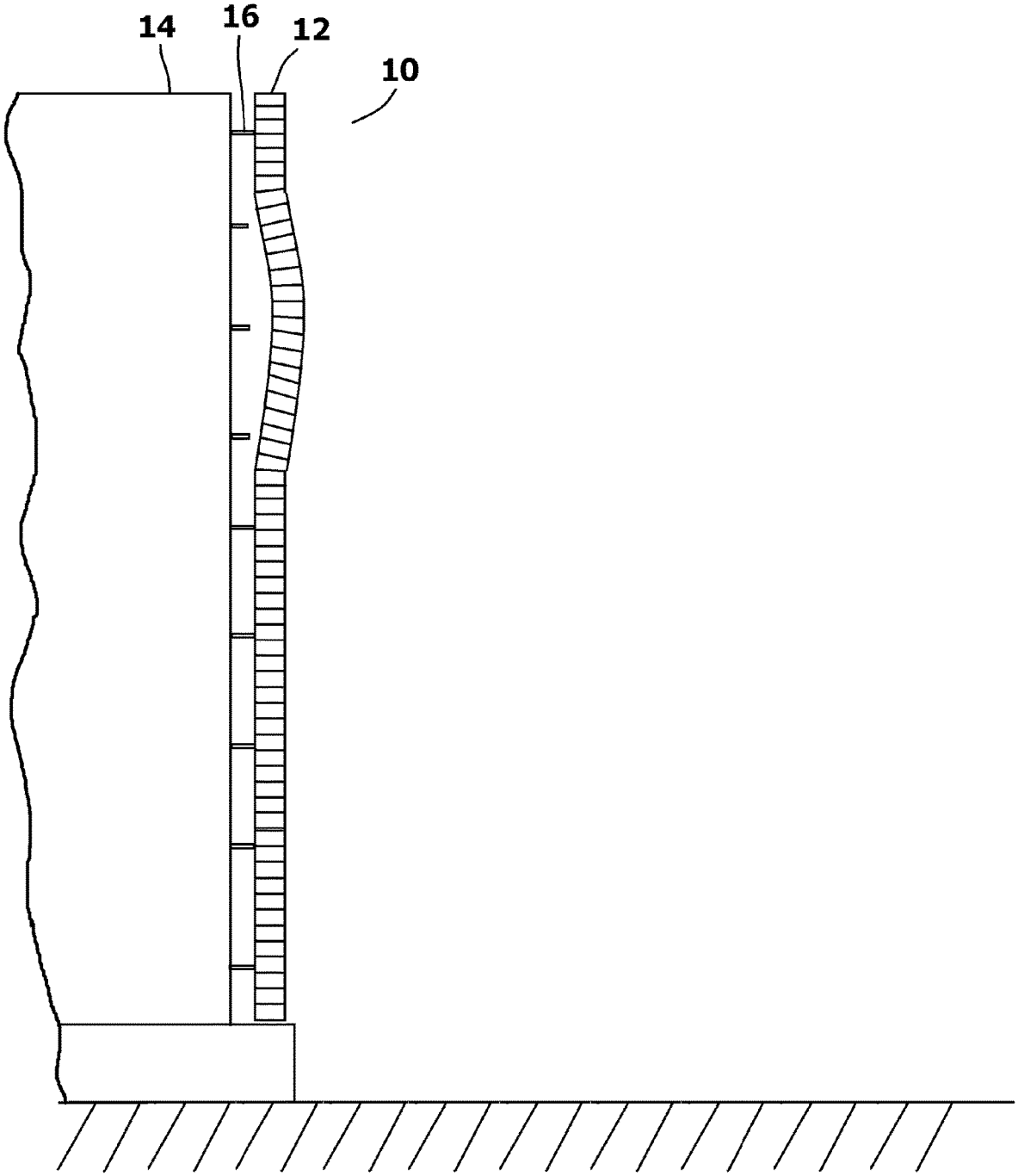
FIG. 1 is a cross-sectional view of an exemplary buckled wall.

Referring to FIG. 1, an exemplary image of a buckled wall 10 is shown. In the shown wall 10 there is an outer wythe 12 of bricks that has buckled. Normally, the outer wythe 12 of bricks is affixed to an inner wall 14 with a variety of anchors 16. This anchoring can also be accomplished with header bricks that extend between the outer wythe 12 and the inner wall 14. When the outer wythe 12 buckles, some of the anchors 16 fail, some do not. As such, the buckled wall 10 has different sections that are oriented at different angles with respect to its original vertical orientation.

Figure 2:
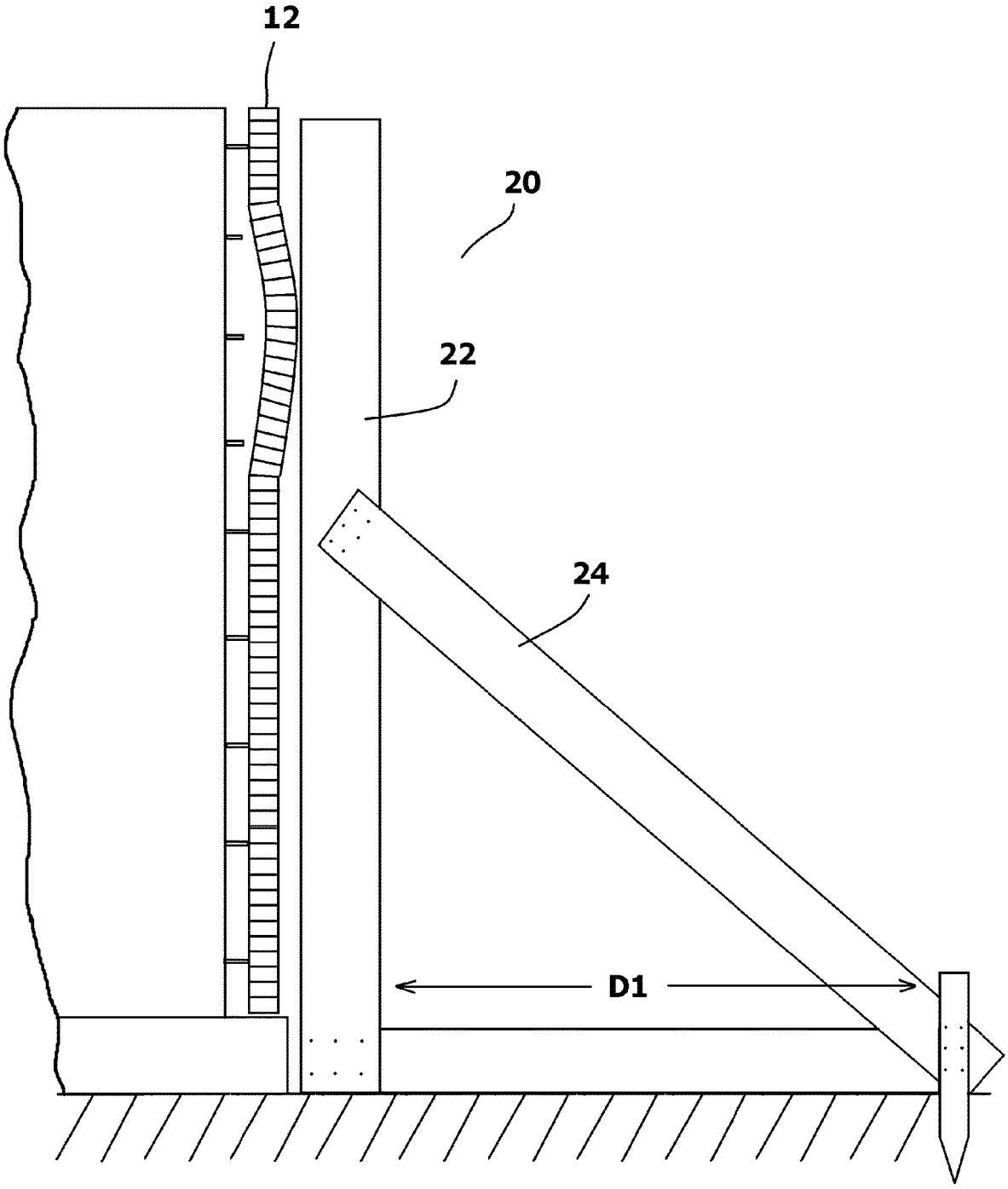
FIG. 2 PRIOR ART
FIG. 2 is cross-sectional view of a prior art support system applied to the exemplary buckled wall of FIG. 1.

Referring to FIG. 2, a prior art support brace system 20 is shown. The support brace system 20 utilizes a vertical brace 22 that is pressed against the outer wythe 12. This is accomplished using angled supports 24 that extend a first distance D1 from the bottom of the outer wythe 12. For strength, the D1 is at least half the height of the vertical brace 22. For example, a vertical brace that is twelve feet high would require at least six feet at the base to accommodate the angled supports 24.

As can be seen, the vertical brace 22 only contacts the buckled wall 10 at a few small points along its length. This greatly limits the amount of support provided to the outer wythe 12. Areas that have not buckled and still have intact support anchors 16 are not supported. As such, the intact support anchors 16 can fail and can create new buckles over time. Additionally, the amount of support provided by the vertical brace 22 is directly dependent upon the angle of the angled supports 24 and the distance D1 available to the angled supports 24 next to the buckled wall 10.

Figure 3:
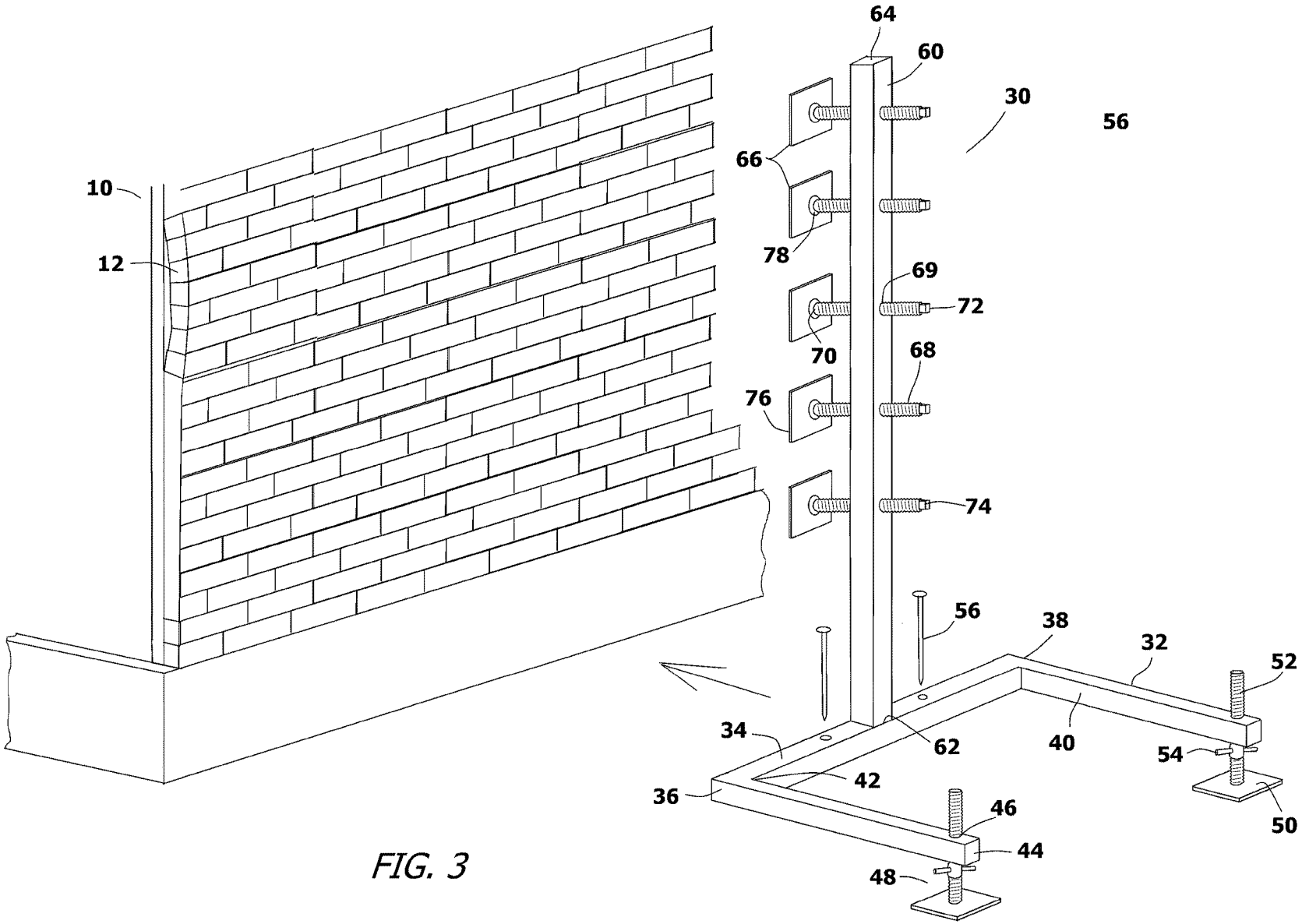
FIG. 3 is a perspective view of an exemplary support system shown supporting a buckled wall.
Figure 4:
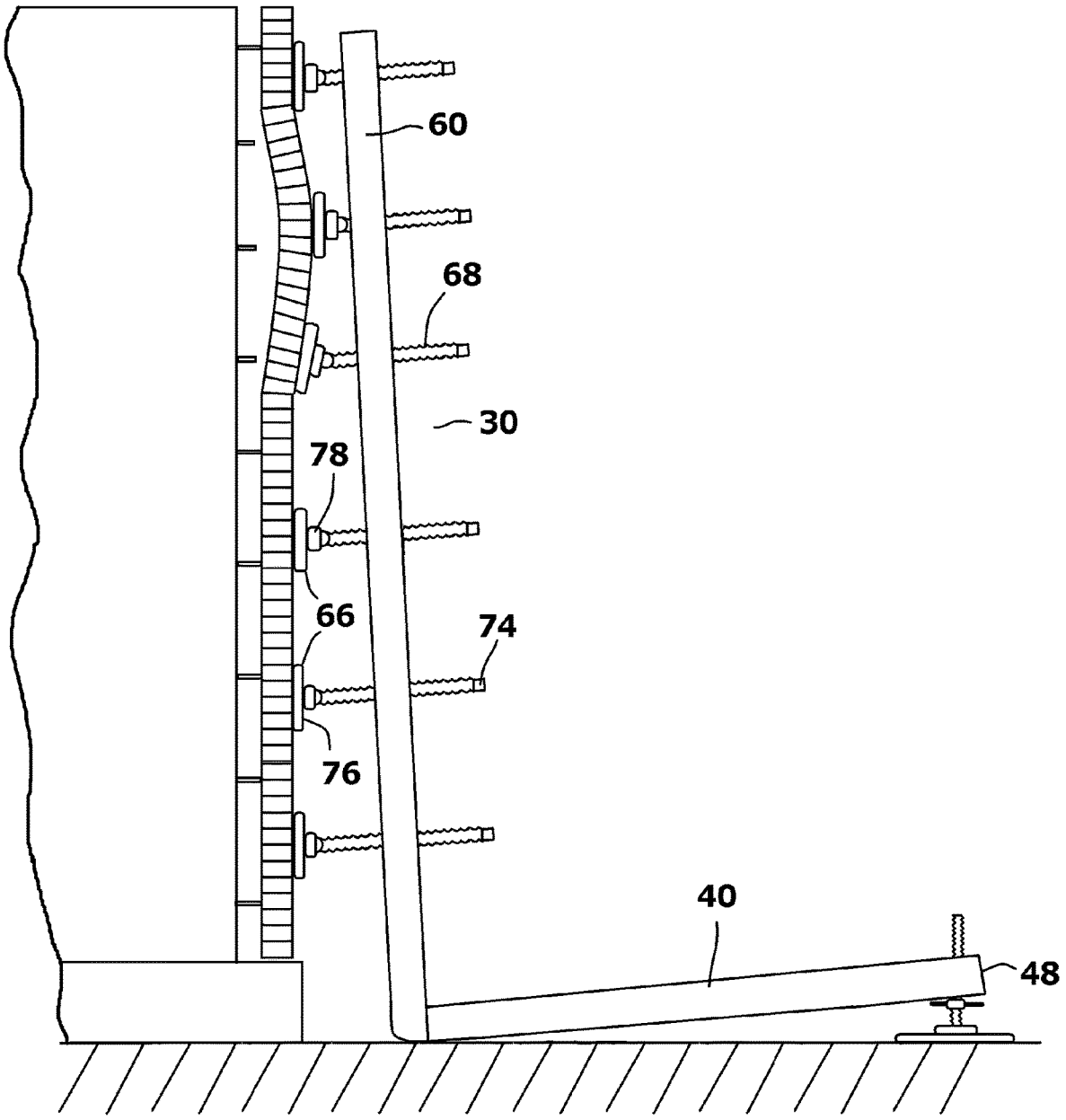
FIG. 4 is a cross-sectional view of the exemplary embodiment of FIG. 3.

Referring to FIG. 3 in conjunction with FIG. 4, a first embodiment of the present invention support system 30 is shown. The support system 30 includes a portable base 32. The portable base 32 has a primary base beam 34 that is placed parallel to the outer wythe 12 of the buckled wall 10. The primary base beam 34 has a length between a first end 36 and a second end 38. The preferred length is between four feet and ten feet. However, other lengths can be used. A plurality of lateral legs 40 extend at a perpendicular from the primary base beam 34. The primary base beam 34 has a lateral leg 40 at both its first end 36 and its second end 38. Additionally, central legs can be added, depending upon the selected length of the primary base beam 34.

Each lateral leg 40 has a first end 42 that is affixed to the primary base beam 34 and an opposite free end 44. A jack receptacle 46 is formed at, or near, the free end 44 of each of the lateral legs 40. The jack receptacles 46 are sized and shaped to receive a screw jack 48. Each screw jack 48 has a baseplate 50, a screw shaft 52, and a threaded support 54 that is selectively adjustable along the screw shaft 52. The threaded support 54 engages the lateral leg 40. As a result, the free end 44 of each lateral leg 40 can be selectively raised or lowered by adjusting the screw jack 48.

The primary base beam 34 remains on the ground as the screw jacks 48 selectively raise and lower the lateral legs 40. A position anchor 56 is preferably provided to help keep the base beam 34 in position. The position anchor 56 can have many forms, depending upon the application. In the shown embodiment, the position anchor 56 includes spikes 58 that are driven through the primary base beam 34 and into the ground. However, it should be understood that the position anchor could also be a chain or similar tether that joins the primary base beam 34 to a building foundation.

A vertical beam 60 is attached to the portable base 32, at or near the center of the primary base beam 34. The vertical beam 60 has a bottom end 62 that is attached to the primary base beam 34 and a free top end 64. The vertical beam 60 has a preferred height of between eight feet and twenty feet. The vertical beam 60 can be adjustable and/or extendable in length, as is shown in later embodiments.

A plurality of adjustable contact braces 66 are attached to the vertical beam 60. Each of the adjustable contact braces 66 has a threaded shaft 68 that extends through a threaded hole 69 in the vertical beam 60. The threaded shaft 68 has a first end 70 that faces the buckled wall 10 and a second end 72 that faces away from the buckled wall 10. The second end 72 is preferably terminated with a nut fitting 74 that enables the threaded shaft 68 to be manually turned by a wrench or similar tool.

The first end 70 of the threaded shaft 68 is terminated with a faceplate 76. The threaded shaft 68 is joined to the faceplate 76 with a ball joint 78 that enables the faceplate 76 to move throughout a range of orientations while remaining affixed to the treaded shaft 68. A locking nut can also be provided on the threaded shaft 68 to lock the threaded shaft 68 in place once adjusted.

To utilize the support system 30, the portable base 32 is placed at the bottom of a buckled wall 10. The screw jacks 48 are attached to the portable base 32. The primary base beam 34 and the baseplates 50 of the screw jacks 48 are anchored to the ground. The vertical beam 60 extends upwardly from the portable base 32, wherein the vertical beam 60 extends in front of the buckled wall 10. The screw jacks 48 are raised to tilt the vertical beam 60 toward the buckled wall 10. The angle of inclination is adjusted so that all of the adjustable contact braces 66 on the vertical beam 60 are within range of a surface of the buckled wall 10. The various contact braces 66 are adjusted to bring the faceplates 76 into contact with various surfaces of the buckled wall 10. Since all of the contact braces 66 have ball joint mounted faceplates 76, each of the faceplates 76 will conform to the angle of the buckled wall 10 that it contacts. The screw jacks 48 and the contact braces 66 are alternately adjusted until each faceplate 76 is biased against the buckled wall 10 with a force sufficient to deter further degradation. The buckled wall 10 will therefore be supported in both areas that are buckled and areas that are not buckled. The buckled wall 10 is stabilized and its degradation either halted or significantly slowed.

Figure 5:
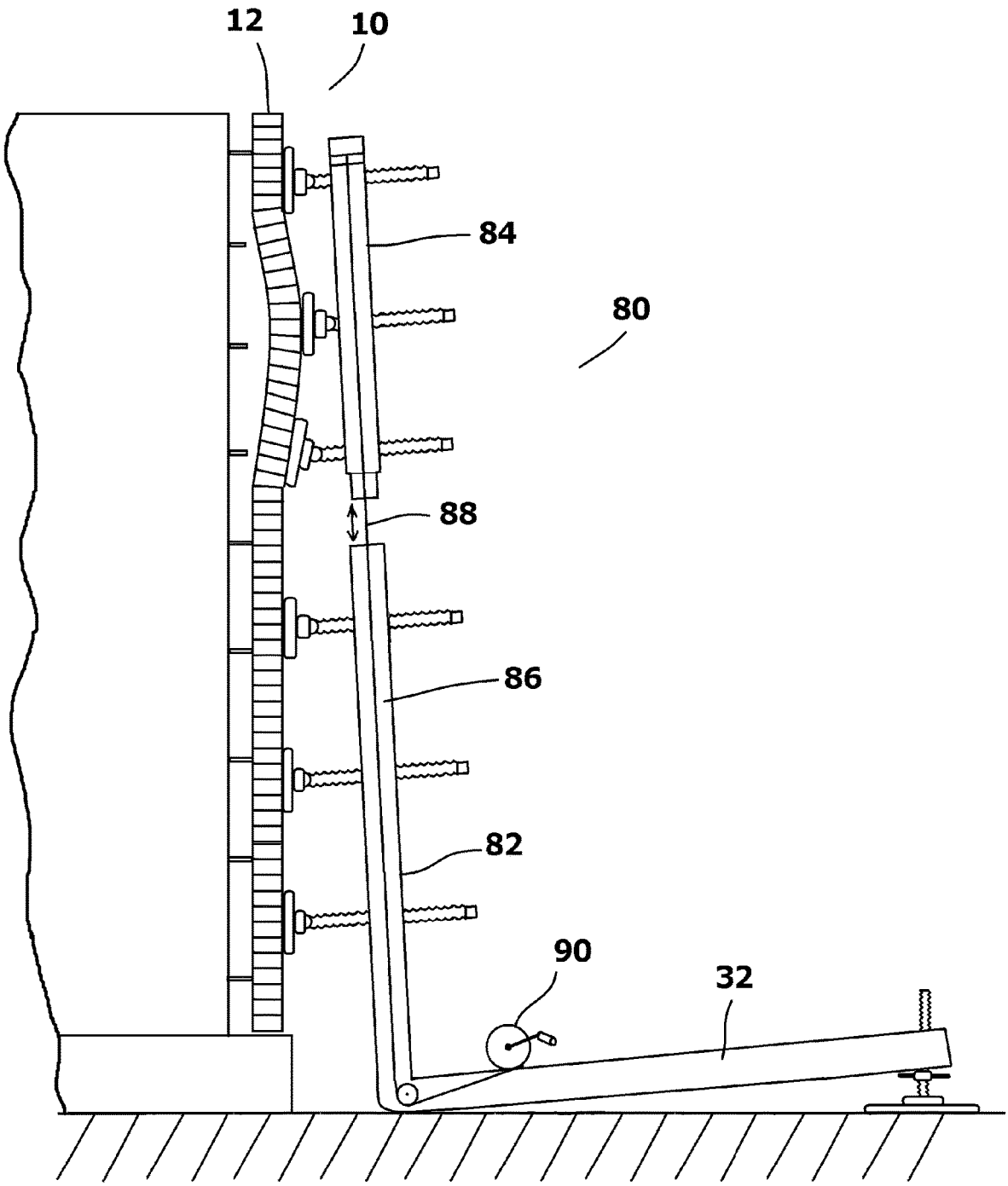
FIG. 5 is a cross-sectional view of an alternate embodiment of a support system supporting a buckled wall.

Referring to FIG. 5, an alternate embodiment of a bracing support system 80 is shown. In this embodiment, the portable base 32 is the same as the original embodiment and is identified using the same reference number. A vertical beam 82 is provided that has interconnecting sections 84, 86. The sections 84, 86 enable the vertical beam 82 to be adjusted to different lengths. In this manner, the vertical beam 82 can be customized for use on buckled walls of different heights.

The sections 84, 86 of the vertical beam 82 interconnect. In order to add additional strength to a vertical pole that is particularly long, an internal tensioning cable 88 can be run through the vertical beam 82. The tensioning cable 88 can be selectively tensioned using a tightening winch 90 mounted to the portable base 32.

Figure 6:
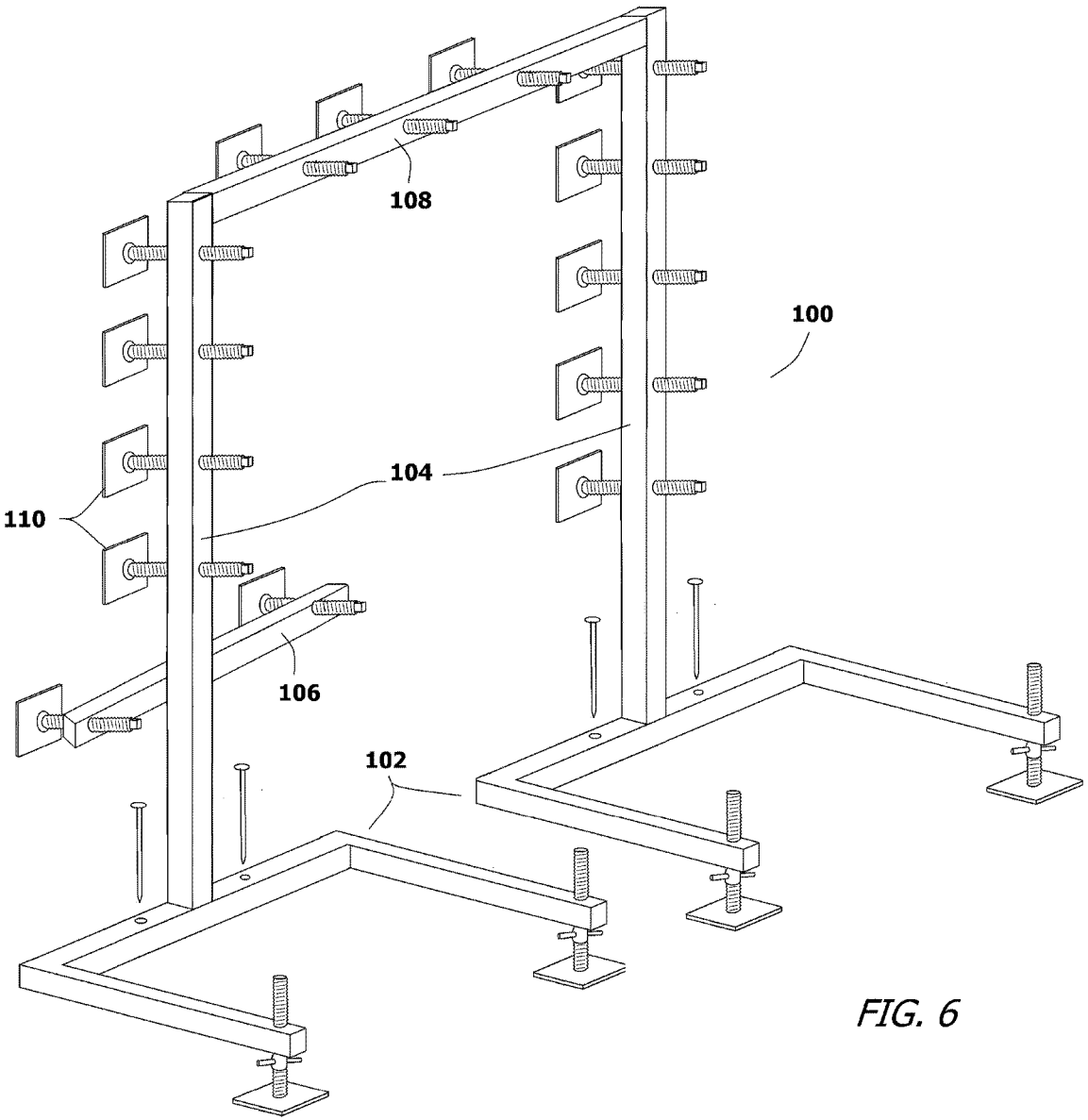
FIG. 6 is a perspective view of another alternate embodiment of a support system supporting a buckled wall.

In the previous embodiments, a single vertical beam and a single portable base are shown. The contact braces are vertically aligned along the length of the vertical beam. It will be understood that more than one support assembly can be placed along the length of a buckling wall, depending upon the running length of the wall. Furthermore, crossbeams can be used. Referring to FIG. 6, a support system 100 is shown that contains multiple portable bases 102 and multiple vertical beams 104. Cross bars 106, 108 extend from the vertical beams 104. Some cross bars 106 terminate with free ends. Some crossbeams 108 can interconnect the vertical beams 104. Contact braces 110 can be positioned on the vertical beams 104 and on both types of crossbeams 106, 108 to provide greater support across the area of a buckled wall 10.

It will be understood that the embodiments of the present invention that are illustrated and described are merely exemplary and that a person skilled in the art can make many variations to those embodiments. For instance, the number, height and size of the contact braces can be altered to accommodate the needs of a particular buckled wall. All such embodiments are intended to be included within the scope of the present invention as defined by the claims.

What is claimed is:

1. A system for supporting a buckled wall, comprising:
- a portable base having a base beam and a lateral leg extending from said base beam;
- a vertical beam extending upwardly from said portable base; and
- a plurality of contact braces supported by said vertical beam, wherein each of said contact braces has a separate faceplate that can be individually adjusted to different distances from said vertical beam.

2. The system according to claim 1, wherein each of said plurality of contact braces has a threaded shaft that engages said vertical beam with a threaded connection, wherein each said threaded shaft terminates with said faceplate at one end.

3. The system according to claim 2, wherein said faceplate is coupled to said threaded shaft with a ball joint that enables said faceplate to alter orientations relative said threaded shaft.

4. The system according to claim 1, further including a jack for lifting said lateral leg, therein rotating said portable base and inclining said vertical beam.

5. The system according to claim 1, further including at least one anchor for anchoring said base beam in a fixed location.

6. The system according to claim 1, wherein said vertical beam is adjustable in height.

7. The system according to claim 1, wherein said vertical beam contains more than one interconnectable section.

8. The system according to claim 1, further including a tension cable extending through said vertical beam.

9. The system according to claim 8, further including a winch for selectively tightening and loosening said tension cable.

10. The system according to claim 1, further including a crossbeam that extends from said vertical beam above said portable base.

11. The system according to claim 10, wherein some of said plurality of contact braces are affixed to said crossbeam.

12. A system for supporting a wall, comprising:
- a portable base that can be positioned adjacent said wall;
- a first beam extending upwardly from said portable base;
- a jack for selectively inclining said portable base and said beam; and
- a plurality of contact braces supported by said first beam, wherein each of said contact braces has a separate faceplate that can be individually adjusted to extend different distances from said first beam.

13. The system according to claim 12, wherein said portable base has a base beam, wherein said first beam intersects said base beam at a perpendicular.

14. The system according to claim 13, wherein said portable base includes a lateral leg that extends from said base beam, wherein said jack acts upon said lateral leg to selectively rotate said base beam and incline said first beam.

15. The system according to claim 12, wherein said plurality of contact braces engages said first beam with adjustable threaded connections.

16. The system according to claim 15, wherein each said faceplate is adjustable and can conform to a wall contacted by said faceplate.

17. A method of supporting a buckling wall, comprising the steps of:
- providing a support structure having a portable base, a vertical beam and adjustable contact braces supported on said vertical beam;
- positioning said a portable base adjacent said buckling wall;
- inclining said portable base to cause said vertical beam to incline toward said buckling wall; and
- individually adjusting said contact braces to contact said buckling wall at different points.

18. The method according to claim 17, wherein each of said contact braces has a faceplate that contacts said buckling wall and conforms to said buckling wall.

19. The method according to claim 17, further including anchoring said portable base at a first distance from said buckling wall.

* * * * *